US006670554B1

(12) United States Patent
Jow et al.

(10) Patent No.: US 6,670,554 B1
(45) Date of Patent: Dec. 30, 2003

(54) HIGH-VOLTAGE DIRECT CURRENT CABLE INSULATION

(75) Inventors: Jinder Jow, Somerville, NJ (US); Alfred Mendelsohn, Brooklyn, NY (US)

(73) Assignee: Union Carbide Chemicals & Plastics Technology Corporation, Danbury, CT (US)

( * ) Notice: Subject to any disclaimer, the term of this patent is extended or adjusted under 35 U.S.C. 154(b) by 0 days.

(21) Appl. No.: 10/263,328

(22) Filed: Oct. 7, 2002

(51) Int. Cl.[7] ..... H01B 3/00
(52) U.S. Cl. ..... 174/110 R
(58) Field of Search ..... 174/110 R, 110 SR, 174/110 PM, 120 SR, 121 A; 525/291; 428/522, 447; 252/511, 512, 513

(56) References Cited

U.S. PATENT DOCUMENTS 5,237,014 A * 8/1993 Barnabeo ..... 525/291
6,106,742 A * 8/2000 Argyropoulos et al. ..... 252/511

FOREIGN PATENT DOCUMENTS

| | | |
|---|---|---|
| JP | 7065633 | 3/1995 |
| JP | 9231839 | 9/1997 |
| WO | WO 99/20685 | 4/1999 |
| WO | WO 99/23145 | 5/1999 |
| WO | WO 99/33066 | 7/1999 |
| WO | WO 99/33067 | 7/1999 |
| WO | WO 99/33068 | 7/1999 |
| WO | WO 99/33069 | 7/1999 |
| WO | WO 99/40589 | 8/1999 |
| WO | WO 99/44206 | 9/1999 |
| WO | WO 99/44207 | 9/1999 |

OTHER PUBLICATIONS

G.C. Montanari and D. Fabiani, "Evaluation of dc Insulation Performance Based on Space–Charge Measurements and Accelerated Life Tests," *IEEE Transactions on Dielectrics and Electrical Insulation*, vol. 7, No. 3, Jun. 2000.

M. Abou–Dakka, A Bulinski, and S. Bamji, "Space Charge Development in XLPE Insulation with and without Tree Retardant Subjected to DC Field," 2000 Conference on Electrical Insulation and Dielectric Phenomena.

M. Salah Khalil, "International Research and Development Trends and Problems of HVDC Cables with Polymeric Insulation," *IEEE Electrical Insulation Magazine*, Nov./Dec. 1997, vol. 13, No. 6.

* cited by examiner

*Primary Examiner*—Chau N. Nguyen

(57) ABSTRACT

A high voltage direct current cable insulation is made from a blend which includes an ethylene copolymer, such as ethylene-alpha olefin copolymer, with low crystallinity to reduce physical space charge trapping sites, a polar polymer modifier in an effective amount to enhance local conductivity to leak space charge quickly when local stress is enhanced, and an ion scavenger to stabilize or neutralize the space charge to provide a composition which is an effective high voltage DC cable insulation.

23 Claims, 1 Drawing Sheet

Figure 1. Space Charge Measurement after 24 hours at + 20 kV/mm
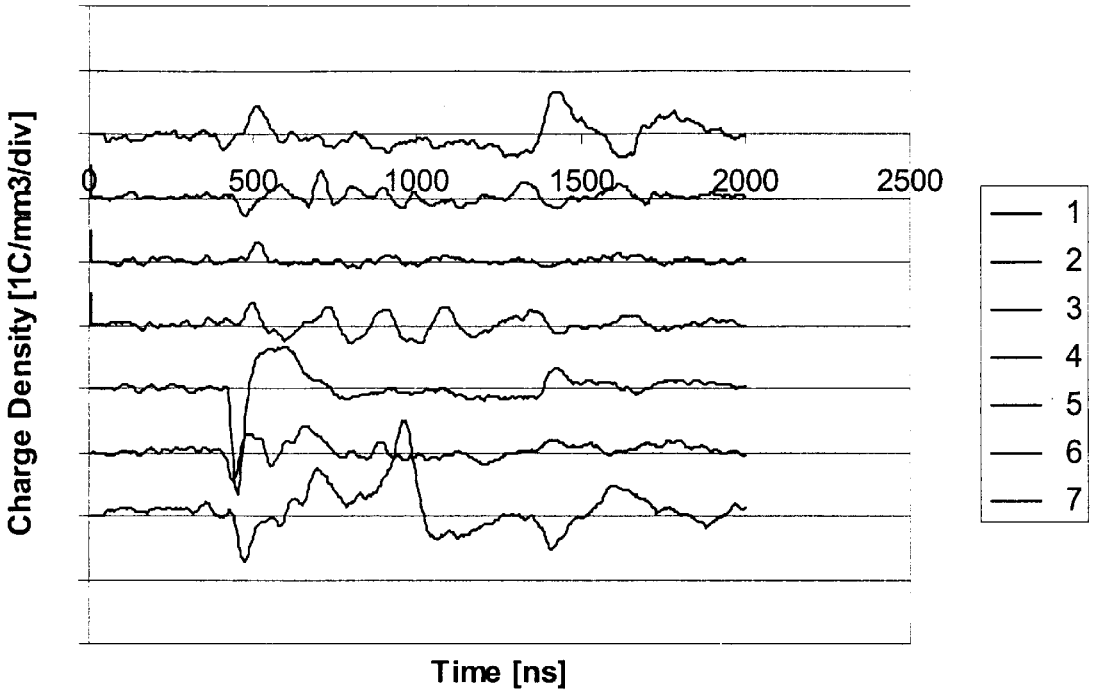
Figure 2. Space Charge Measurement after 24 hours at - 20 kV/mm
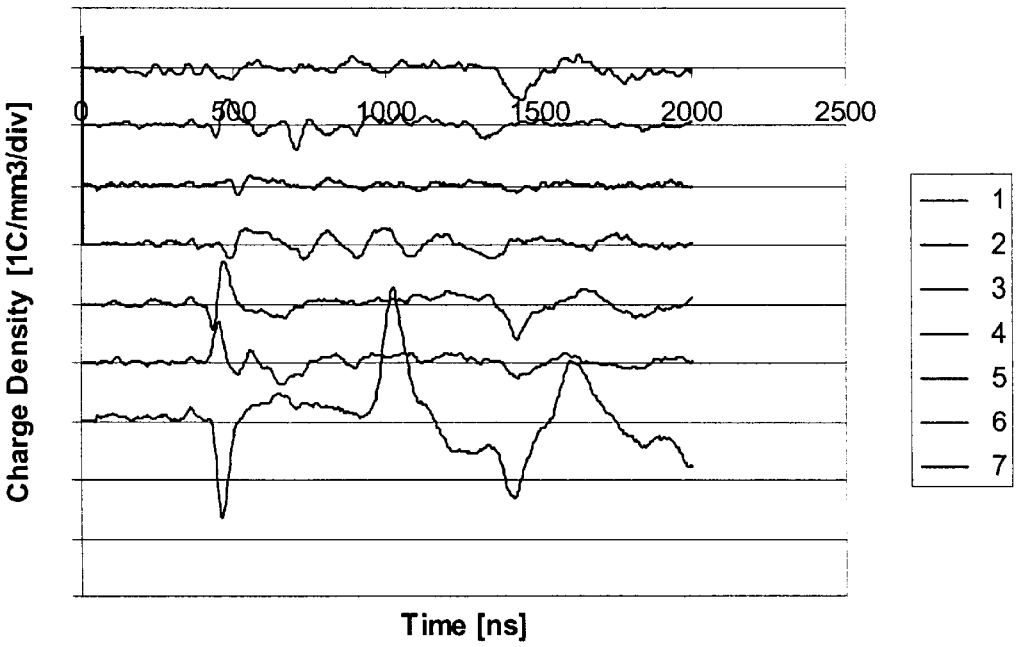

HIGH-VOLTAGE DIRECT CURRENT CABLE INSULATION

FIELD OF THE INVENTION

This invention is directed to insulation for power cables. More particularly, this invention is directed to insulation for high voltage direct current power cables.

BACKGROUND

Direct Current (DC) power transmission has several advantages over alternating current (AC) power transmission. DC current transmission does not have a length limit, permits long-distance submarine cables (>50 km), has good connectivity among different networks/sources (such as, windmills), has lower operating costs due to low conductor loss and no power loss, has superior power quality and flow control for system reliability/stability and has higher voltage ratings. Cables insulated with oil/paper insulation have been successfully used for high voltage direct current (HVDC) applications since 1954. Cables insulated with crosslinked polyethylene can have several advantages over cables insulated with oil/paper for HVDC applications. The advantages of crosslinked polyethylene include lower manufacturing costs, lower operation costs, easier maintenance for utilities, higher temperature ratings (such as, 90° C. vs. 60° to 70° C.) to utilities, and environmental friendliness due to no oil leakage.

Polymeric dielectric insulating materials, particularly polyethylene without modification, however, can not be used for HVDC applications. These materials have local space charge buildup which can significantly enhance local fields under surge or lightning impulse, have charge neutralizations during reverse polarity which can reduce local DC breakdown strength, and have stress inversions due to temperature-dependent conductivity which can reverse local field enhancement.

A known approach to develop HVDC polymeric cable insulation products has been to have low and well-distributed space charge traps. Space charge can be trapped by physical traps formed between crystallinity and amorphous boundaries or chemical traps due to chemical structures of substances. The instant invention, however, is a cable insulation made from a blend which includes an ethylene copolymer, such as an ethylene-alpha olefin copolymer with low crystallinity to reduce physical space charge trapping sites. The invention uses at least one polar polymer modifier in an effective amount to enhance local conductivity to leak space charge quickly when local stress is enhanced, and at least one ion scavenger to stabilize or neutralize the space charge to provide a composition which is an effective high voltage DC cable insulation.

SUMMARY OF THE INVENTION

The invention is directed to (1) a direct current cable which includes insulation which resists breakdown and deterioration when exposed to high-voltage direct current, (2) an insulation composition which resists deterioration and breakdown when exposed to high-voltage direct current, and (3) a method for reducing the deterioration of such insulation. The cable insulation composition includes at least one crosslinked non-polar, low crystallinity resin with a density of less than 0.900 g/cc which tends not to trap charge or create charge trap sites for a cable insulation temperature rating of at least 90° C. In another aspect, the resin is not crosslinked or is crosslinked only in a low amount (hereinafter a non-crosslinked polymer) which is effective for providing a cable insulation with a temperature rating of 75° C. or above. In either aspect, the cable insulation also includes (1) at least one polar polymeric modifier which dissipates or leaks charge quickly under high fields, (2) at least one ion scavenger which stabilizes or neutralizes space charges, and (3) optionally at least one heat stabilizer which minimizes internal charge generation during in service thermal degradation of insulation.

The crosslinked non polar low crystalline resin, polar polymeric modifier, ion scavenger and heat stabilizer are in amounts effective for achieving temperature rating of 90° C. or above, a charge density less of than 2 Coulomb/mm$^3$ measured by a pulsed electro acoustic (PEA) method after 24 hours with either positive or negative 20 kV/mm applied. For the cable insulation which has a temperature rating of not more than 75° C. the amount and extent of crosslinking of such resin, the amounts of polar polymeric modifier, ion scavenger and heat stabilizer all are effective for achieving temperature rating of 75° C. or above, a charge density less of than 2 Coulomb/mm$^3$ measured by a pulsed electro acoustic (PEA) method after 24 hours with either positive or negative 20 kV/mm applied.

In another aspect, the invention is a high-voltage direct current cable insulation composition which has a temperature rating of 90° C. or above and which comprises a blend of or which is made from a blend of at least one cross-linked ethylene copolymer, such as ethylene/alpha olefin polymer, having a density of less than 0.900 g/cc, a melt index of from 0.5 to 10 g/10 minutes, a crystallinity of less than about 10%; at least one polar polymeric modifier in an amount effective to provide field conductivity and permitting leakage of space and charge only at high fields; at least one ion scavenger in an amount effective to reduce charge build-up relative to a blend which does not include an ion scavenger; and, optionally, at least one heat stabilizer in an amount effective to prevent thermally induced degradation and resulting internal charge generation. The polar polymeric modifier, ion scavenger, and optional heat stabilizer are in amounts and ratios which when in combination with the crosslinked resin provide the insulation with a charge density less than 2 Coulomb/mm$^3$ measured by a PEA method after 24 hours with either positive or negative 20 kV/mm applied.

In another aspect, for cable insulation which has a temperature rating of 75° C. or above, the cable insulation composition comprises a non polar, non-crosslinked ethylene copolymer, such as an ethylene/alpha olefin copolymer, having a density of less than 0.900 g/cc a melt index of from 0.5 to 10 g/10 minutes, a crystallinity of less than about 10%; at least one polar polymeric modifier in an amount effective to provide field conductivity and permitting leakage of space and charge only at high fields; at least one ion scavenger in an amount effective to reduce charge build-up relative to a blend which does not include an ion scavenger; and, optionally, at least one heat stabilizer in an amount effective to prevent thermally induced degradation and resulting internal charge generation. The polar polymeric modifier, ion scavenger, and optional heat stabilizer are in amounts and ratios which when in combination with the resin provide the insulation with a charge density less than 2 Coulomb/mm$^3$ measured by a PEA method after 24 hours with either positive or negative 20 kV/mm applied.

In yet another aspect, the invention is a high-voltage direct current cable insulation which comprises a blend of or which is made from a blend of at least one crosslinked ethylene-butene or hexene olefin polymer having a density of less than 0.900 g/cc, a melt index of from 0.5 to 10 g/10 minutes; from 0.1 to 15 weight percent of at least one polar polymeric modifier; from 0.05 to 0.5 weight percent of at least one charge scavenger to reduce charge build-up, and optionally, from 0.1 to 5 weight percent of at least one heat stabilizer in an amount effective to prevent thermally induced degradation and resulting internal charge generation.

BRIEF DESCRIPTION OF THE FIGURES

FIG. 1 describes PEA space charge measurements after 24 hours at +20 kV/mm.

FIG. 2 describes PEA space charge measurements after 24 hours at −20 kV/mm.

DETAILED DESCRIPTION OF THE INVENTION

The non polar ethylene copolymer which can be used in the invention includes ethylene/alpha olefin interpolymers, such as an ethylene/propylene copolymer. The resin has low crystallinity and has a density of less than 0.90 g/cc. In a very important aspect, the resin used in the invention is a $C_2$–$C_6$ alpha olefin copolymer. Low crystallinity means a crystallinity of less than 20% as determined by a differential scanning calorimeter. The alpha olefin resins which may be used in the invention include:

an ethylene-hexene copolymer made with a single site catalyst (SSC), an ethylene-butene copolymer made with a Ziegler Natta (Z/N) catalyst, and an ethylene-octene copolymer made with a SSC catalyst. The non polar ethylene copolymer may have some polar components, but such polar components should not be in such an amount to make the resin crystalline and loose its amorphous characteristics. Hence, the non polar resin may have ethylene/styrene copolymer, an ethylene vinyl acetate copolymer, an ethylene/ethyl acrylate copolymer in low amounts. In the aspect of the invention which includes a crosslinked resin, the resin may be crosslinked using a peroxide, irradiation or a moisture cure.

Polar polymer modifiers are polymeric materials having at least one polar component. These polar components may be a part of the polymer structure as side groups which group may be residues of maleic anhydride, vinyl acetate and vinyl acrylate, where such compounds have been incorporated into the polymer, such as by grafting or were a part of the monomer precursor of the polymer. Polar components also may include hydroxyl group, styrenic group and carboxyl group. The polar polymeric modifier may be polyethylene glycol (where the polar component is hydroxyl group), ethylene ethyl acrylate (where the polar component is a residue of vinyl acrylate), ethylene styrene copolymer (where the polar component is a styrenic group) or a polyester having an acid number (where the polar component is a carboxyl group). The polar polymer modifiers may include maleic-anhydride-grafted very low density ethylene/alpha olefin copolymers having a density of less than about 0.900 g/cc as described above having about 0.3% maleic anhydride, polycaprolactone resins (having a carboxyl group in the main chain with a diol group at the end) and mixtures thereof.

Ion scavengers are compounds which have chelating groups, such as hydroxyl and carboxyl. Ion scavengers may include 1,2-bis(3,5-di-tert-butyl-4-hydroxyhydrocinnamoyl)hydrazine, poly[[6-[1,1,3,3-tetramethylbutyl)amino]-s-triazine-2,4-diyl] [2,2,6,6-tetramethyl-4-piperidyl)imino]hexamethylene [(2,2,6,6-tetramethyl-4-piperidyl)imino], N,N'-bis(0-hydroxybenzal) oxalydihydride, barbituric acid, tertiary phosphorous acid ester of a thiobisphenol, and N,N'-diphenyuloxamid, and mixtures thereof.

Antioxidants also may be put into the insulation compositions. Antioxidants which may be used include:

1,3,5-tris(4-tert-butyl-3-hydroxy-2,6-dimethylbenzyl)-1,3,5-triazine-2,4,6-(1H, 3H, 5H)-trione, commercially available as Cyanox 1790; and distearylthiodipropionate (DSTDP).

For a crosslinked insulation composition with a temperature rating of 90° C., its elongation and set at a temperature of 150° C. per ICEA T-28-562 test method should not be greater than 175% and 10%, respectively. The alternative referee method is the solvent extraction test per ASTM D2765. The crosslinked insulation composition generally will have maximum extractables after 20 hours drying time of no more than 30%. Insulation with a temperature rating of 75° C. generally requires having percent retained tensile strength and elongation at break of no less than 70% after heat aged at 113° C. for 7 days in air-circulated over per UL-1581 standard.

EXAMPLES 1–7

Examples 1, 2, 3, 4 and 6 illustrate the invention. Examples 5 and 7 are comparative examples.

The space charge measurements were performed by a pulsed electro acoustic method. The details of this method can be found in literature as described in Y. Li, M. Yasuda, and T. Takad, "*Pulsed Electro-acoustic Method for Measurement of Charge Accumulation in Solid Dielectrics*," IEEE Transaction EI, Vol. 1, pp. 188–195, 1994.

Each sample had 1.6 mm thickness with a diameter of 135 mm, placed between semicon electrodes of 0.1 mm and a diameter of 30 mm, placed between semicon electrodes of 0.1 mm and diameter of 30 mm. The application of 32 kV DC (20 kV/mm) was applied for 24 hours, and space charge was measured-by PEA without voltage applied as shown in FIG. 1. The sample was grounded without applied voltage for 12 hours, and then voltage was applied with −32 kV DC (20 kV/mm) for 24 hours. The space charge without voltage applied was measured again by the PEA as shown in FIG. 2. All measurements were done at ambient temperature about 20° C. Space charge measurements were plotted as charge density (Coulomb per cubic millimeter) as a function of time (nano-second). Each division shown in FIGS. 1 and 2 is equivalent to a value of 2Coloumb/mm$^3$.

For HVDC cable applications, HVDC cable insulation should keep the space charge as low as possible and as uniform as possible throughout the measurement of time. The value of space charge measurement for excellent HVDC cable insulation should be no more than 2Coloumb/mm$^3$ for both positive and negative DC stress.

TABLE I

HVDC INSULATION

| Ingredient | Functionality | 1 | 2 | 3 | 4 | 5 | 6 | 7 |
|---|---|---|---|---|---|---|---|---|
| Ethylene/hexene copolymer made with SSC catalyst available as Exact 4033 from Exxon Chemical (0.8 MI; 0.880 g/cc) | low crystallinity low MI VLDPE | 89.28 | 97.28 | 95.28 | 85.28 | 99.38 | | |
| DGH-8480, available from Dow Chemical (0.8 MI; 0.884 g/cc, | | | | | | | 97.26 | |
| Engage 8003, available from Dow Chemical (1 MI; 0.885 g/cc) | | | | | | | | 97.28 |
| Low density polyethylene grafted with maleic anhydride (0.3 wt. % polymer) DEFA-1373, available from Dow Chemical (2 MI; 0.903 g/cc) | polar polymer modifier | 10.00 | | | 10.00 | | | |
| Polylactone resin (MI = 30, D = 1.145, 8/cc, MP60° C.) commercially available as Tone Polymer P-787 from Dow Chemical | polar polymer modifier | | 2.00 | 2.00 | 2.00 | | 2.00 | 2.00 |
| Zinc Oxide commercially available as Kadox 911P from Zinc Corporation of America | heat stabilizer/phonon dissipator | | | 2.00 | 2.00 | | | |
| 1,2-bis(3,5-di-tert-butyl-4-hydroxyhydrocinnamoyl)hydrazine which is commercially available as Irganox 1024 from Ciba | ion scavenger | 0.10 | 0.10 | 0.10 | 0.10 | | 0.10 | 0.10 |
| poly[[6-[1,1,3,3-tetramethyl-butyl)amino)-s-triazine-2,4-diyl] [2,2,6,6-tetramethyl-4-piperidyl)imino]hexamethylene [(2,2,6,6-tetramethyl-4-piperidyl)imino]], commercially available as Chmissorb 944 from Ciba | ion scavenyer | 0.25 | 0.25 | 0.25 | 0.25 | 0.25 | 0.25 | 0.25 |
| Cyanox 1790 | primary antioxidant | 0.14 | 0.14 | 0.14 | 0.14 | 0.14 | 0.14 | 0.14 |
| DSTDP, available from Great Lakes Chemical | secondary antioxidant | 0.23 | 0.23 | 0.23 | 0.23 | 0.23 | 0.23 | 0.23 |
| Total Percentage | | 100 | 100 | 100 | 100 | 100 | 100 | 100 |
| Thermoplastics | | 99.2 | 99.2 | 99.2 | 99.2 | 99.2 | 99 | 99 |
| Dicup R | | 0.8 | 0.8 | 0.8 | 0.8 | 0.8 | 1 | 1 |

Effect of Additives

Example 5 containing typical antioxidants and UV stabilizer did not meet the desired requirement on space charge value at the applied positive DC stress of 20 kV/mm. However, Examples 1 and 2 with Irganox 1024 and two different polar polymer modifiers, respectively, met the desired requirements at both positive and negative DC stresses. Example 2 showed lower space charge distribution than Example 1. Example 3 with additional heat stabilizer, zinc oxide, showed further improvement in space charge when compared with Example 2. Example 4 with the combination of additive packages from Example 3 and 1 showed acceptable space charge performance.

Effect of the Resins

Examples 2, 6, and 7 showed the effect of various VLDPE resins on space charge distribution. Example 7 made by octene comonomer did not meet the space charge distribution criteria with the levels of polymer modifier and ion scavenger shown.

What is claimed is:

1. High voltage direct current cable insulation comprising:

a blend of or which is made from a blend of at least one ethylene/alpha olefin polymer having a density of less than about 0.900 g/cc, a melt index of from about 0.5 to about 10 g/10 minutes, a crystallinity of less than about 10% and a catalyst residue of less than about 1000 ppm;

at least one polar polymer modifier in an amount effective to provide an insulation made with the blend with an enhanced field conductivity and enhanced space charge leakage at high fields relative to an insulation made with a blend which does not include a polar polymer modifier;

at least one ion scavenger in an amount effective to reduce ionic mobility relative an insulation made with a blend which does not include an ion scavenger;

the ethylene/alpha olefin polymer, the polar polymer modifier and the ion scavenger being in amounts to provide the cable insulation with a charge density of less than 2 Coulomb/mm$^3$ measured by a pulsed electro acoustic method after 24 hours with either positive or negative 20 kV/mm applied.

2. The high voltage direct current insulation of claim 1, wherein the blend further includes at least one heat stabilizer.

3. The high voltage direct current insulation of claim 1, wherein the polar polymer modifier is selected from the group consisting of (i) a polymer having a density of less than 0.900 g/cc with at least one side group selected from the group consisting of hydroxyl, carboxyl, styrenic; (ii) a polymer having a density of less than 0.900 g/cc and at least one side group which is a residue of maleic anhydride, vinyl acetate or vinyl acrylate; (iii) a polylactone resin and; (iv) mixtures thereof, and wherein the ion scavenger has at least one chelating group.

4. The high voltage direct current insulation as recited in claim 3, wherein the ion scavenger is selected from the group consisting of 1,2-bis(3,5-di-tert-butyl-4-hydroxyhydrocinnamoyl)hydrazine, poly[[6-[1,1,3,3-tetramethylbutyl)amino]-s-triazine-2,4-diyl] [2,2,6,6-tetramethyl-4-piperidyl)imino]hexamethylene[(2,2,6,6-tetramethyl-4-piperidyl)imino]] N,N'-bis(0-hydroxybenzal) oxalydihydride, barbituric acid, tertiary phosphorous acid ester of a thiobisphenol, and N,N'-diphenyuloxamid, and mixtures thereof.

5. The high voltage direct current insulation of claims 1, 2, 3 or 4, wherein the ethylene/alpha olefin polymer is cross-linked.

6. High voltage direct current cable insulation comprising:

a blend of or which is made from a blend of at least one ethylene/alpha olefin polymer having a density of less than about 0.900 g/cc, a melt index of from about 0.5 to about 10 g/10 minutes, a crystallinity of less than about 10% and a catalyst residue of less than about 1000 ppm;

from about 0.1 to about 15 weight percent of at least one polar polymer modifier having at least one polar component;

from about 0.05 to about 0.5 weight percent of at least one ion scavenger having at least one chelating component; and the ethylene/alpha olefin polymer, the polar polymer modifier and the ion scavenger being in amounts to provide the cable insulation with a charge density of less than 2 Coulomb/mm$^3$ measured by a pulsed electro acoustic method after 24 hours with either positive or negative 20 kV/mm applied.

7. The high voltage direct current insulation of claim 6, wherein the blend further includes at least one heat stabilizer.

8. The high voltage direct current insulation of claim 6, wherein the polar polymer modifier is selected from the group consisting of (i) a polymer having a density of less than 0.900 g/cc with at least one side group selected from the group consisting of hydroxyl, carboxyl, styrenic; (ii) a polymer having a density of less than 0.900 g/cc and at least one side group which is a residue of maleic anhydride, vinyl acetate or vinyl acrylate; (iii) a polylactone resin and; (iv) mixtures thereof, and wherein the ion scavenger has at least one chelating group.

9. The high voltage direct current insulation as recited in claim 8, wherein the ion scavenger is selected from the 20 group consisting of 1,2-bis(3,5-di-tert-butyl-4-hydroxyhydrocinnamoyl)hydrazine, poly[[6-[1,1,3,3-tetramethylbutyl)amino]-s-triazine-2,4-diyl] [2,2,6,6-tetramethyl-4-piperidyl)imino]hexamethylene[(2,2,6,6-tetramethyl-4-piperidyl)imino]] N,N'-bis(0-hydroxybenzal) oxalydihydride, barbituric acid, tertiary phosphorous acid ester of a thiobisphenol, and N,N'-diphenyuloxamid, and mixtures.

10. The high voltage direct current insulation of claims 6, 8 or 9 wherein the ethylene/alpha olefin polymer is crosslinked.

11. High voltage direct current cable insulation comprising:

a blend of or which is made from a blend of at least one ethylene copolymer selected from the group consisting of a copolymer of ethylene/butene, ethylene/hexene and mixtures thereof the polyethylene copolymer having a density of less than about 0.900 g/cc, a melt index of from about 0.5 to about 10 g/10 minutes, a crystallinity of less than about 10% and a catalyst residue of less than about 1000 ppm;

at least one polar polymer modifier having at least one polar component in an amount effective to provide an insulation made with the blend with an enhanced field conductivity and enhanced space charge leakage at high fields relative to an insulation made with a blend which does not include a polar polymer modifier;

at least one ion scavenger having at least one chelating component in an amount effective to reduce ion mobility relative to an insulation made with a blend which does not include an ion scavenger; and the polyethylene copolymer, the polar polymer modifier and the ion scavenger being in amounts to provide the cable insulation with a charge density of less than 2 Coulomb/mm$^3$ measured by a pulsed electro acoustic method after 24 hours with either positive or negative 20 kV/mm applied.

12. The high voltage direct current insulation of claim 11, wherein the blend further includes at least one heat stabilizer.

13. The high voltage direct current insulation of claim 11, wherein the polar polymer modifier is selected from the group consisting of (i) a polymer having a density of less than 0.900 g/cc with at least one side group selected from the group consisting of hydroxyl, carboxyl, styrenic; (ii) a polymer having a density of less than 0.900 g/cc and at least one side group which is a residue of maleic anhydride, vinyl acetate or vinyl acrylate; (iii) a polylactone resin and; (iv) mixtures thereof, and wherein the ion scavenger has at least one chelating group.

14. The high voltage direct current insulation as recited in claim 11, wherein the ion scavenger is selected from the group consisting of 1,2-bis(3,5-di-tert-butyl-4-hydroxyhydrocinnamoyl)hydrazine, poly[[6-[1,1,3,3-tetramethylbutyl)amino]-s-triazine-2,4-diyl] [2,2,6,6-tetramethyl-4-piperidyl)imino]hexamethylene[(2,2,6,6-tetramethyl-4-piperidyl)imino]] N,N'-bis(0-hydroxybenzal) oxalydihydride, barbituric acid, tertiary phosphorous acid ester of a thiobisphenol, and N,N'-diphenyuloxamid, and mixtures thereof.

15. The high voltage direct current insulation of claims 11, 13 or 14 wherein the ethylene copolymer is crosslinked.

16. High voltage direct current cable insulation comprising a blend or which is made from a blend of at least one non polar, low crystalline ethylene copolymer selected from the group consisting of ethylene/propylene copolymer, ethylene/styrene copolymer, and mixtures thereof, the ethylene copolymer having a density of less than about 0.900 g/cc, a melt index of from about 0.5 to about log/10 minutes, a crystallinity of less than about 10% and a catalyst residue of less than about 1000 ppm;

at least one polar polymer modifier having at least one polar component in an amount effective to provide an insulation made with the blend with an enhanced field conductivity and enhanced space charge leakage at high fields relative to an insulation made with a blend which does not include a polar polymer modifier;

at least one ion scavenger having at least one chelating component in an amount effective to reduce ion mobility relative to an insulation made with a blend which does not include an ion scavenger; and the polyethylene copolymer, the polar polymer modifier and the ion scavenger being in amounts to provide the cable insulation with a charge density of less than 2 Coulomb/mm$^3$ measured by a pulsed electro acoustic method after 24 hours with either positive or negative 20 kV/mm applied.

17. The high voltage direct current insulation of claim 16, wherein the blend further includes at least one heat stabilizer.

18. The high voltage direct current insulation of claim 16, wherein the polar polymer modifier is selected from the group consisting of (i) a polymer having a density of less than 0.900 g/cc with at least one side group selected from the group consisting of hydroxyl, carboxyl, styrenic; (ii) a polymer having a density of less than 0.900 g/cc and at least one side group which is a residue of maleic anhydride, vinyl acetate or vinyl acrylate; (iii) a polylactone resin and; (iv) mixtures thereof, and wherein the ion scavenger has at least one chelating group.

19. The high voltage direct current insulation as recited in claim 16, wherein the ion scavenger is selected from the group consisting of 1,2-bis(3,5-di-tert-butyl-4-hydroxyhydrocinnamoyl)hydrazine, poly[[6-[1,1,3,3-tetramethylbutyl)amino]-s-triazine-2,4-diyl] [2,2,6,6-tetramethyl-4-piperidyl)imino]hexamethylene[(2,2,6,6-tetramethyl-4-piperidyl)imino]] N,N'-bis(0-hydroxybenzal) oxalydihydride, barbituric acid, tertiary phosphorous acid ester of a thiobisphenol, and N,N'-diphenyuloxamid, and mixtures thereof.

20. The high voltage direct current insulation of claims 16, 18 or 19 wherein the ethylene copolymer is crosslinked.

21. A high voltage direct current cable comprising:

an electrical conductor; and cable insulation comprising a blend or which is made from a blend of at least one non polar, low crystalline ethylene copolymer selected from the group- consisting of ethylene/propylene copolymer, ethylene/styrene copolymer, and mixtures thereof, the -ethylene copolymer having a density of less than about 0.900 g/cc, a melt index of from about 0.5 to about 10 g/10 minutes, a crystallinity of less than about 10% and a catalyst residue of less than about 1000 ppm;

at least one polar polymer modifier having at least one polar component in an amount effective to provide an insulation made with the blend with an enhanced field conductivity and enhanced space charge leakage at high fields relative to an insulation made with a blend which does not include a polar polymer modifier;

at least one ion scavenger having at least one chelating component in an amount effective to reduce ion mobility relative to an insulation made with a blend which does not include an ion scavenger; and the polyethylene copolymer, the polar polymer modifier and the ion scavenger being in amounts to provide the cable insulation with a charge density of less than 2 Coulomb/mm$^3$ measured by a pulsed electro acoustic method after 24 hours with either positive or negative 20 kV/mm applied.

22. The high voltage direct current cable as recited in claim 21 wherein the ethylene copolymer is crosslinked.

23. A method for providing a cable insulation with a charge density of less than 2 Coulomb/m$^3$ measured by a pulsed electro acoustic method after 24 hours with either positive or negative 20 kV/mm applied, the method comprising mixing at least one ethylene/alpha olefin polymer having a density of less than about 0.900 g/cc, a melt index of from about 0.5 to about 10 g/10 minutes, a crystallinity of less than about 10% and a catalyst residue of less than about 1000 ppm;

from about 0.1 to about 15 weight percent of at least one polar polymer modifier having at least one polar component;

from about 0.05 to about 0.5 weight percent of at least one ion scavenger having at least one chelating component; and the ethylene/alpha olefin polymer, the polar polymer modifier and the ion scavenger being in amounts to provide the cable insulation with a charge density of less than 2 Coulomb/mm$^3$ measured by a pulsed electro acoustic method after 24 hours with either positive or negative 20 kV/mm applied.

* * * * *

UNITED STATES PATENT AND TRADEMARK OFFICE

CERTIFICATE OF CORRECTION

PATENT NO. : 6,670,554 B1
DATED : December 30, 2003
INVENTOR(S) : Jow et al.

It is certified that error appears in the above-identified patent and that said Letters Patent is hereby corrected as shown below:

Column 7,
Line 46, delete “20”.

Column 8,
Line 48, change “log/10” to -- 10/g10 --.
Line 55, after “space” insert -- and --.

Column 9,
Line 33, change “-ethylene” to -- ethylene --.

Signed and Sealed this

Eighteenth Day of May, 2004

JON W. DUDAS
*Acting Director of the United States Patent and Trademark Office*